US005970993A

United States Patent [19]

Witherspoon et al.

[11] Patent Number: 5,970,993

[45] Date of Patent: Oct. 26, 1999

[54] PULSED PLASMA JET PAINT REMOVAL

[75] Inventors: F. Douglas Witherspoon, Fairfax Station; Russell W. Kincaid; Dennis W. Massey, both of Manassas, all of Va.

[73] Assignee: Utron Inc., Manassas, Va.

[21] Appl. No.: 08/943,241

[22] Filed: Oct. 3, 1997

Related U.S. Application Data

[60] Provisional application No. 60/027,643, Oct. 4, 1996.

[51] Int. Cl.[6] ..... B08B 7/00

[52] U.S. Cl. ..... 134/1.1; 134/1; 134/38; 134/39

[58] Field of Search ..... 134/1.1, 1, 1.2, 134/38, 39, 40, 42

[56] References Cited

U.S. PATENT DOCUMENTS

| | | | |
|---|---|---|---|
| 3,212,914 | 10/1965 | Lyle et al. . | |
| 3,621,179 | 11/1971 | Tylko . | |
| 4,142,089 | 2/1979 | Lau et al. . | |
| 4,374,075 | 2/1983 | Yolton et al. . | |
| 4,555,612 | 11/1985 | Collins et al. | 219/121.36 |
| 4,689,463 | 8/1987 | Shubert . | |
| 4,715,261 | 12/1987 | Goldstein et al. . | |
| 4,821,508 | 4/1989 | Burton et al. . | |
| 4,821,509 | 4/1989 | Burton et al. . | |
| 4,974,487 | 12/1990 | Goldstein et al. . | |
| 5,033,355 | 7/1991 | Goldstein et al. . | |
| 5,062,364 | 11/1991 | Lewis et al. | 101/467 |
| 5,206,059 | 4/1993 | Marantz . | |
| 5,235,914 | 8/1993 | Williams et al. | 101/467 |
| 5,262,206 | 11/1993 | Rangaswamy et al. . | |
| 5,272,979 | 12/1993 | Lewis et al. | 101/467 |
| 5,425,231 | 6/1995 | Burton . | |
| 5,442,153 | 8/1995 | Marantz et al. . | |
| 5,562,841 | 10/1996 | Kulik et al. | 219/121.59 |

FOREIGN PATENT DOCUMENTS 0232594 11/1986 European Pat. Off. .

OTHER PUBLICATIONS

H. Herman, "Plasma–sprayed Coatings," Scientific American, pp. 112–117 Sep. 1988.

Burton, R.L., et al., "Experiments on a Repetitively Pulsed Electrother and Thruster," J. Propulsion and Power, vol. 6, No. 2, p. 139, 1990.

Marantz, David R., et al., "State of the Art Arc Spray Technology," NTSC Proceedings, pp. 113–118, May 1990.

Steffens, H.–D., et al., "Recent Developments in Arc Spraying," IEEE Transactions on Plasma Science, vol. 18, No. 6, Dec. 1990.

(List continued on next page.)

*Primary Examiner*—Jill Warden
*Assistant Examiner*—Alexander Markoff
*Attorney, Agent, or Firm*—James Creighton Wray; Meera P. Narasimhan

[57] ABSTRACT

Paint is removed from bridges and structures by directing pulsed plasma jets at coatings on surfaces. The repetitively pulsed plasma jets ablate the coatings, and the resulting products are removed by reduced pressure in an enclosure. Plasma jets in an array are moved along a surface, with the jets overlapping. Power is controlled to remove the topcoats and one or more layers of topcoat without damaging an underlying primer coat, or to remove a primer coat to the bare surface. Jets in the array overlap to completely remove the coating. The pulsed plasma jets impact the surfaces directly in front of the plasma jets, and the gases flow outward, carrying ablated materials away from the surfaces. The enclosures have openings near the coated surface for allowing the inflow of ambient air into the reduced pressure enclosure to prevent escape of ablated products from the enclosure. The use of inert gas working fluid reduces formation of undesirable byproducts. The application of pulsed plasma jets removes coatings, and paint in particular, with minimal waste and contaminants. The array is moved uniformly along the surface to effect complete removal without contaminating the environment, while minimizing hazardous waste disposal requirements.

42 Claims, 9 Drawing Sheets

OTHER PUBLICATIONS

Marantz, D.R., et al., "Wire–Arc Plasma Spray Process–Basic Principles and Its Versatility," NTSC Proceedings, pp. 381–387, May 1991.
Steffens, H.D., et al., "One Wire Vacuum Arc Spraying–A New Modified Process," NTSC Proceedings, pp. 395–398, May 1991.
Longo, F.N., "Industrial Guide–Markets, Materials, and Applications for Thermal–Sprayed Coatings," Journal of Thermal Spray Tech., vol. 1(2), pp. 143–145, Jun. 1992.
Berndt, C.C., et al., "Current Problems in Plasma Spray Processing," Journal of Thermal Spray Technology, vol. 1(4), pp. 341–356, Dec. 1992.
Sampson, E.R., "The Economics of Arc. vs. Plasma Spray for Aircraft Components," NTSC Proceedings, Jun. 1993.
Byrnes, L., et al., "Method and Apparatus for the Application of Therm Spray Coatings onto Aluminum Engine Cylinder Bores," NTSC Proceedings, Jun. 1994.
Scholl, M., "Plasma Spraying with Wire Feedstock," NTSC Proceedings, pp. 491–496, Jun. 1994.
Steffens, H.–D., et al., "The Sonarc Process: Combining the Advantages of Arc and HVOF Spraying," Journal of Thermal Spray, vol. 3(4), pp. 398–403, Dec. 1994.
Steffens, H.–D., et al., "Recent Developments in Single–Wire Vacuum Arc Spraying," Journal of Thermal Spray, vol. 3(4), pp. 412–417, Dec. 1994.
Shcolnikov, E.Ya., et al., "Acceleration of Powder Materials in an Electrothermal Launcher," IEEE Transactions on Magnetics, vol. 31, No. 1 pp. 758–763, Jan. 1995.
Neiser, R.A., et al., "Wire Melting and Droplet Atomization in a HVOF Jet," NTSC Proceedings, pp. 99–104, Sep. 1995.
Meyer, W.B., "Metal Spraying in the U.S.: A JTST Historical Paper," Journal of Thermal Spray, vol. 5(1), pp. 79–83, Mar. 1996.
Kowalsky, K.A., et al., "Characterization of Coatings Produced by the Wire–Arc–Plasma Spray Process", NTSC Proceedings, pp. 389–394, May 1991.

PULSED PLASMA JET PAINT REMOVAL

BACKGROUND OF THE INVENTION

This application claims the benefit of U.S. Provisional application Ser. No. 60/027/643, filed Oct. 4, 1996.

This invention was made with Government support under Contract DMI-9710967 awarded by the National Science Foundation. The Government has certain rights in this invention.

Removal of paint from outdoor structures is a problem of immense national importance, affecting hundreds of thousands of structures in the commercial, defense and public sectors. In fact, more than half of the nation's 577,000 bridges require immediate repairs totaling more than $50 billion. Most of this needed repair work is due to failed coatings, primarily paint, which has led to deterioration of the underlying structure. Besides bridges, there are enormous numbers of other structures, both public and privately owned, which are in need of repairs due to rust and decay. All of the military services rely on paint to protect buildings, equipment and vehicles. The Navy, in particular, has billions of dollars invested in port facilities and ships, all of which are necessarily located in highly corrosive air environments. These assets must be protected against corrosion. This means paint in one form or another. Civil and military aircraft require regular stripping and repainting.

The problem with paint is that it typically only lasts a decade at best, sometimes less. When a paint coating fails, it must be replaced. For lead based paints, this usually means just applying another coat of paint over the old coat. This is routinely done for the nation's bridges because it is the cheapest near term solution. However, over the years this leads to the buildup of toxic levels of lead on these structures. New paints with inorganic zincs that last longer and do not contain lead are becoming available but suffer an expensive disadvantage, namely, they must be applied to bare metal. This means the old layers of paint must be removed first.

Current methods for the removal of paint typically produce large amounts of dust and waste or have a low removal rate. Sandblasting has traditionally been the primary technique for paint removal. It is effective, but can shower the local area with a huge quantity of paint residue and contaminated sand particles. When lead compounds are present in the paint, this contaminated sand/paint residue cannot be allowed to escape into the environment. Federal and state regulatory agencies have begun to require that structures being sandblasted be completely enclosed within a plastic bubble. This forces workers to operate inside the enclosure and this means they must wear completely enclosed suits with self-breathing apparatus. In spite of these many extensive and expensive precautions, workers still develop lead poisoning.

Environmental regulations are pushing painting costs to $\$5/ft^2$, roughly five times the cost of simply applying another layer of lead paint. No one really knows how to contain these blasting residues safely.

In addition to the immediate health and environmental problems, there are long term problems associated with disposal of the blasting residue. Current EPA regulations ban the disposal of untreated toxic waste in landfills. Sandblasting a bridge and collecting the residue, for instance, generates hazardous waste at 8 to 10 $lbs/ft^2$ of bridge surface, hundreds to thousands of tons per structure. Bridge painting projects have been cancelled or delayed because there is no economical way to dispose of the lead-contaminated blasting residue.

Present paint removal methods include sandblasting, abrasive grinding, plastic media blasting, laser ablation, flash UV ablation, wheat starch, water jets, frozen $CO_2$ pellets, cryogenic sprays, high velocity ice particles, and hot gas blasting. None of these approaches currently provide the desired performance.

SUMMARY OF THE INVENTION

Paint is removed from bridges and structures by directing pulsed plasma jets at coatings on surfaces. The pulsed plasma jets ablate the coatings, and the resulting products are removed by reduced pressure in an enclosure connected to suction pumps. Plasma jets in an array are moved along a surface, with the jets overlapping. Power is controlled to remove the topcoats and one or more layers of topcoat without damaging an underlying primer coat, or to remove a primer coat to the bare surface. Jets in the array overlap to completely remove the coating. The pulsed plasma jets impact the surfaces directly in front of the plasma jets, and the gases flow outward, carrying ablated materials away from the surfaces. The enclosures have openings near the coated surface for allowing the inflow of ambient air into the reduced pressure enclosure to prevent escape of ablated products from the enclosure. The use of inert gas working fluid reduces formation of undesirable byproducts. The application of pulsed plasma jets removes coatings, and paint in particular, with minimal waste and contaminants. The array is moved uniformly along the surface to effect complete removal without contaminating the environment, while minimizing hazardous waste disposal requirements.

This invention provides a method of safely removing paint from common structural materials such as steel, aluminum, other metals, concrete, and wood. The process provides for the rapid and efficient removal of thin layers of virtually any coating in a repetitive vaporization process. Coating material is carried away in substantially gaseous form, which eliminates the mess and environmental concerns associated with traditional methods such as sandblasting, since no paint residue is allowed to escape into the atmosphere. Residual waste is reduced to the irreducible minimum, i.e. the paint itself. Potential health risks to workers and the local population are eliminated. The local environment is not contaminated, and enclosing bubbles or tents, as often needed in sandblasting, are not required. Paint can be removed at rates into the 100's of square feet per hour, with no environmental cleanup required afterwards. The process also provides selective removal of topcoats without damage to the underlying primer coat. This will have major impact on the military and commercial aircraft industry which is pushing for permanent primer coats and replaceable top coats.

Two primary applications are removing paints from steel-based infrastructure (bridges, railroad cars, tank farms, ships) and from aluminum-based systems (mainly military and commercial aircraft). The technology is directly applicable to the removal of other kinds of surface coatings (besides paints) without damage to the substrate and could have significant commercial potential in the materials processing industry. The technology is directly applicable to the immediate and safe removal of lead paints from the nation's bridges.

The most desirable starting combination of heat flux, pulse width, and pulse rate for ablative removal of paint from a substrate is roughly 10 $kW/cm^2$, 20 $\mu s$, and 1 kHz rate. Pulse energies are roughly 10 J. It is more effective to remove paint via low pulse energies at high rep rate than high pulse energies at low rep rates. This reduces efficiency losses due to the vapor shield effect. The electrical energy required to remove paint by the proposed method and the estimated rates of removal as a function of average electrical power input are described.

For the calculated transient substrate surface temperature increases (typically <100° C.) and short time durations (10's of $\mu$s) involved, no microstructural changes, phase transformations, or solid state precipitation will occur even for repeated energy pulses.

The invention incorporates the following features. A paint removal head moves in three dimensions to accommodate various size test articles. The system is portable. The integral suction pump removes vapors and particulates. Provisions are made for sampling the constituents of the ablated material vapor.

Energy requirements and removal rates are commercially attractive. An average operating power of 50 kW removes 0.007" thick paint coatings at a rate of 140 $ft^2$/hr based on the single-pulse, unoptimized, proof-of-principle tests. Optimized removal rates 5–18 times larger are attainable as described further below and in Table 3.

The pulsed plasma generator specific components include the capillary, nozzle, power supply and power conditioning system. Two capillary discharge devices can be operated electrically in series using one high voltage power supply to reduce part count, or multiple capillary discharge devices can be operated independently with separate power supplies when required. Provisions are made for arc initiation, argon gas feed, and unit cooling.

The invention is applicable to removing coatings of all kinds, with paint being the most important near term application.

These and further and other objects and features of the invention are apparent in the disclosure, which includes the above and ongoing written specification, with the claims and the drawings.

BRIEF DESCRIPTION OF THE DRAWINGS

Table 1 is a table of the thermal properties of various materials of interest.

Table 2 details the thermal wave depth in micrometers at two different times for the same materials in Table 1.

Table 3 summarizes the estimated removal rates for paint coatings 0.007" thick for various average power operating levels. The rates are based on test data from proof-of-principle tests and estimates of anticipated rates when system is optimized for repetitive operation.

Figure 1:
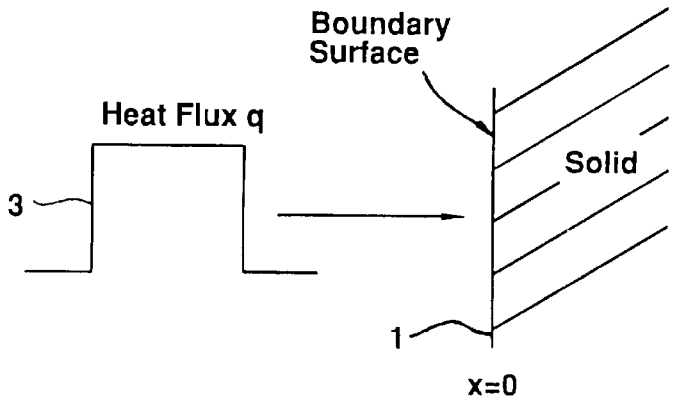
Figure 2:
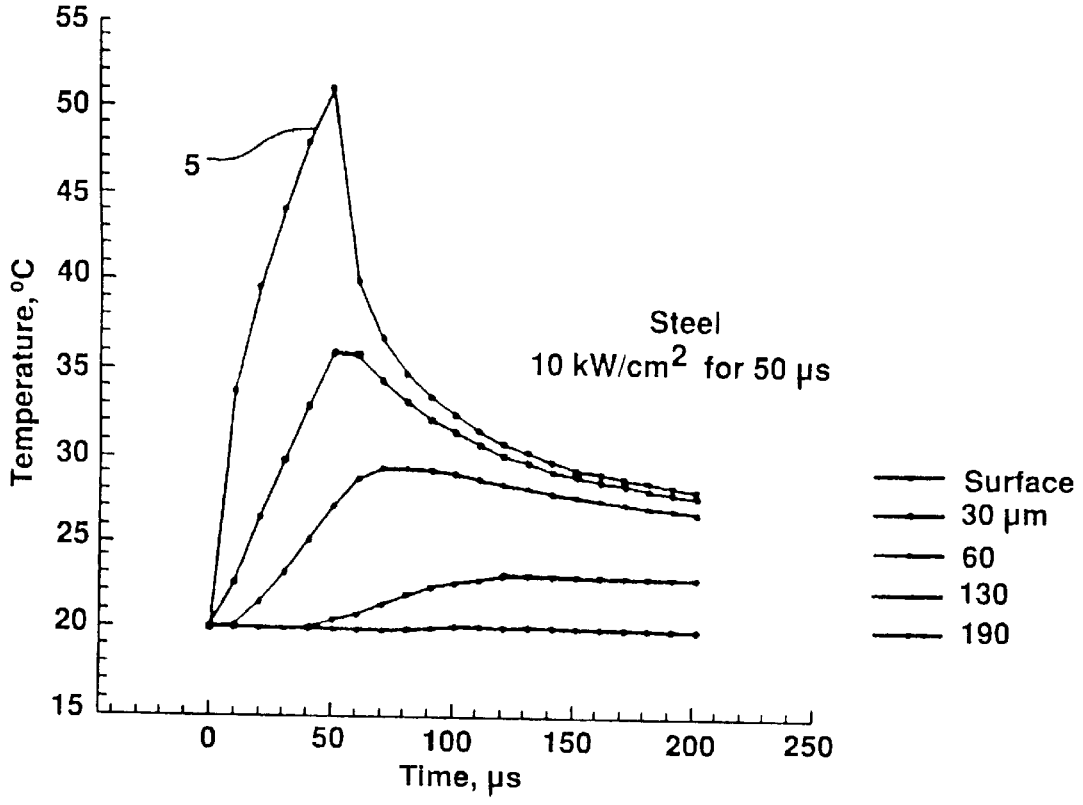
Figure 3:
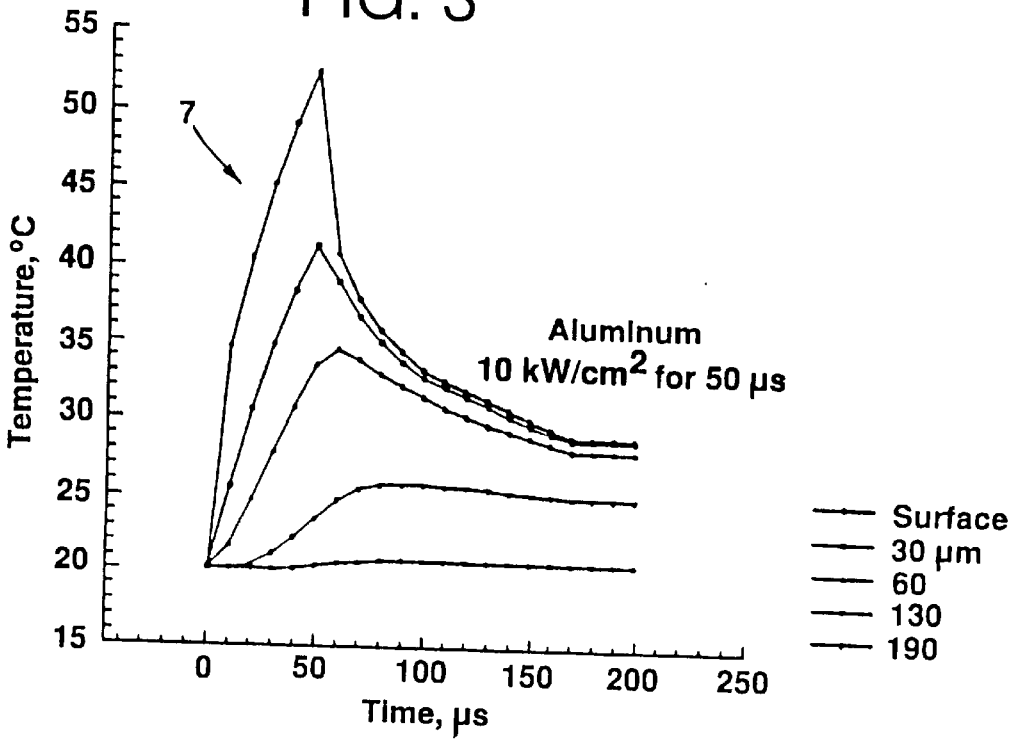
Figure 4:
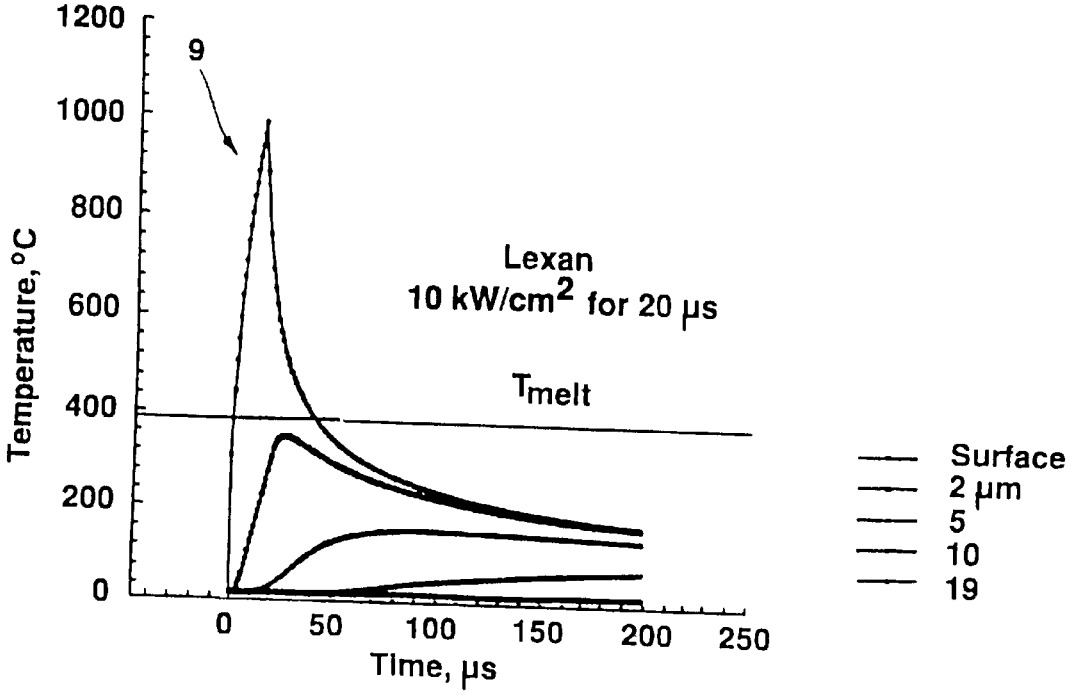

FIG. 1 shows a solid surface exposed to a brief but intense heat flux, which experiences a short-lived surface temperature rise as shown in FIGS. 2, 3, and 4 for various materials.

FIG. 2 shows temperature time history at various depths in steel for incident heat flux of 10 kW/$cm^2$.

FIG. 3 shows temperature time history at various depths in aluminum for incident heat flux of 10 kW/$cm^2$.

FIG. 4 shows temperature time history at various depths in Lexan for incident heat flux of kW/$cm^2$.

Figure 5:
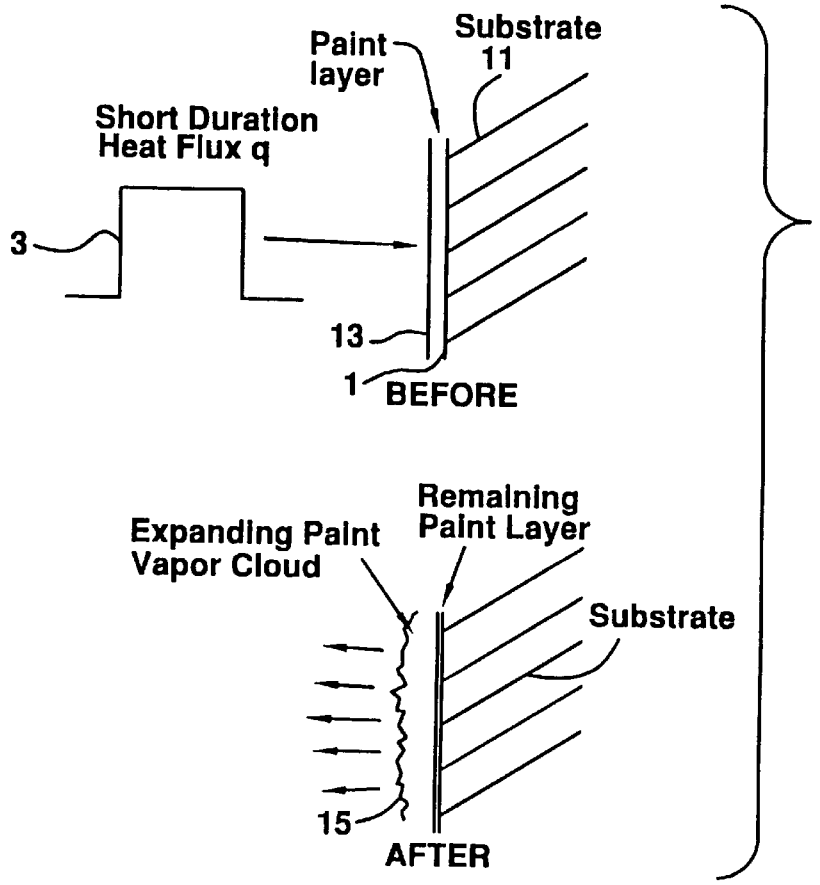

FIG. 5 shows a short but intense heat pulse which ablates partial paint layer. The 1-D picture shown is actually more characteristic of laser ablation in which the ablated products come off normal to the surface and interfere with incoming radiation.

Figure 6:
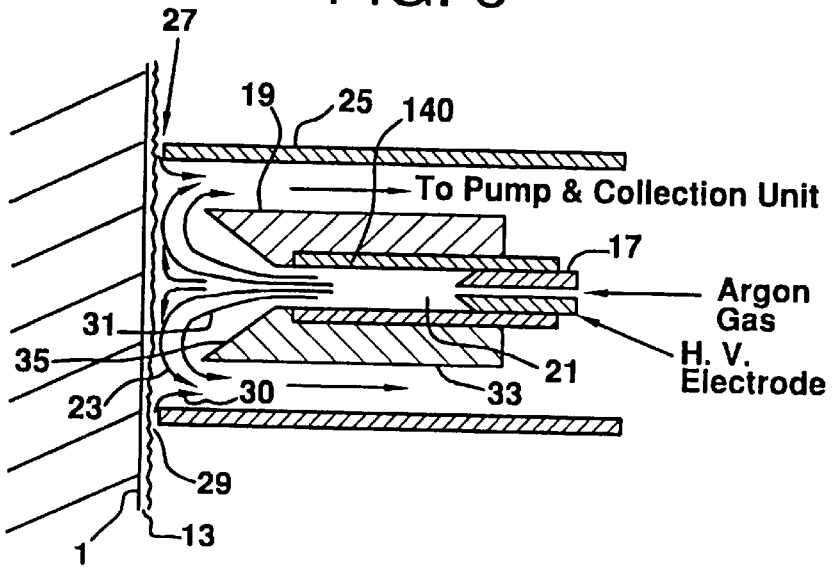

FIG. 6 shows the pulsed plasma jet ablation scheme, which removes paint via rapid and repeated application of very short pulses of intense heat resulting from the incident plasma jet. The scheme is inherently 2-D due to the stagnation point and the redirection of plasma flow from normal incidence to parallel flow along the surface. The plasma jet acts to quickly remove ablated vapors, thus reducing energy requirements.

Figure 7:
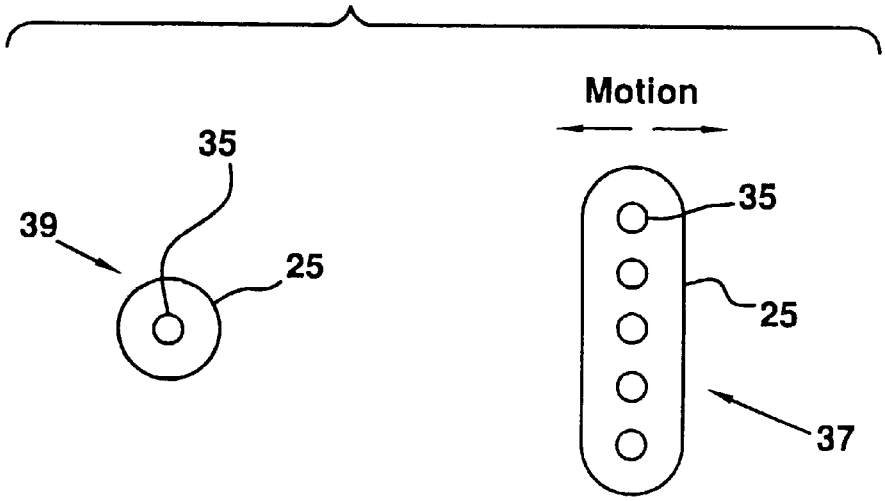

FIG. 7 shows an end view of two different representative plasma jet configurations.

Figure 8A:
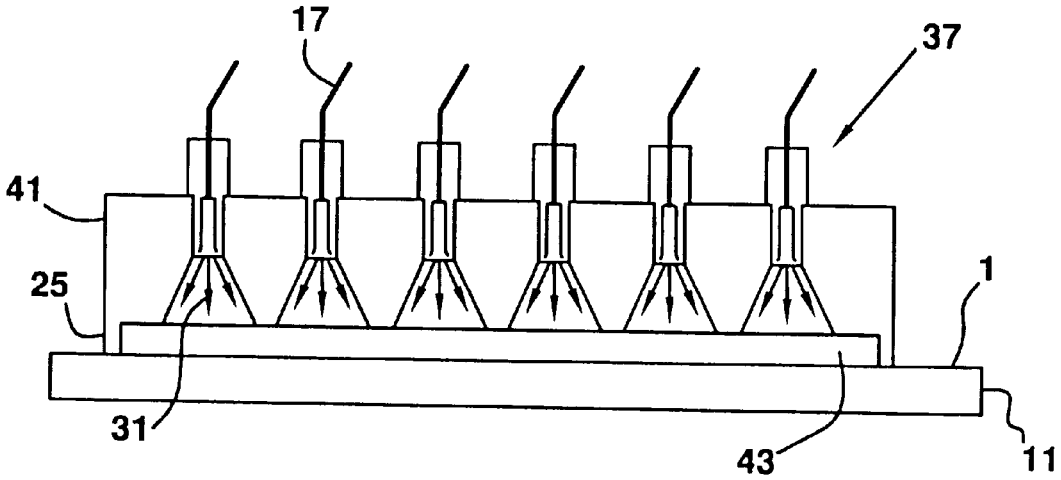

FIG. 8A shows a side view of a linear array of several plasma jets providing a wide swath for paint or other coating removal. This technique for increasing the swath width is limited only by practical constraints regarding physical size and available electric power. One or two dimensional arrays can easily be envisioned using 10–20 jets allowing swaths several inches wide.

Figure 8B:
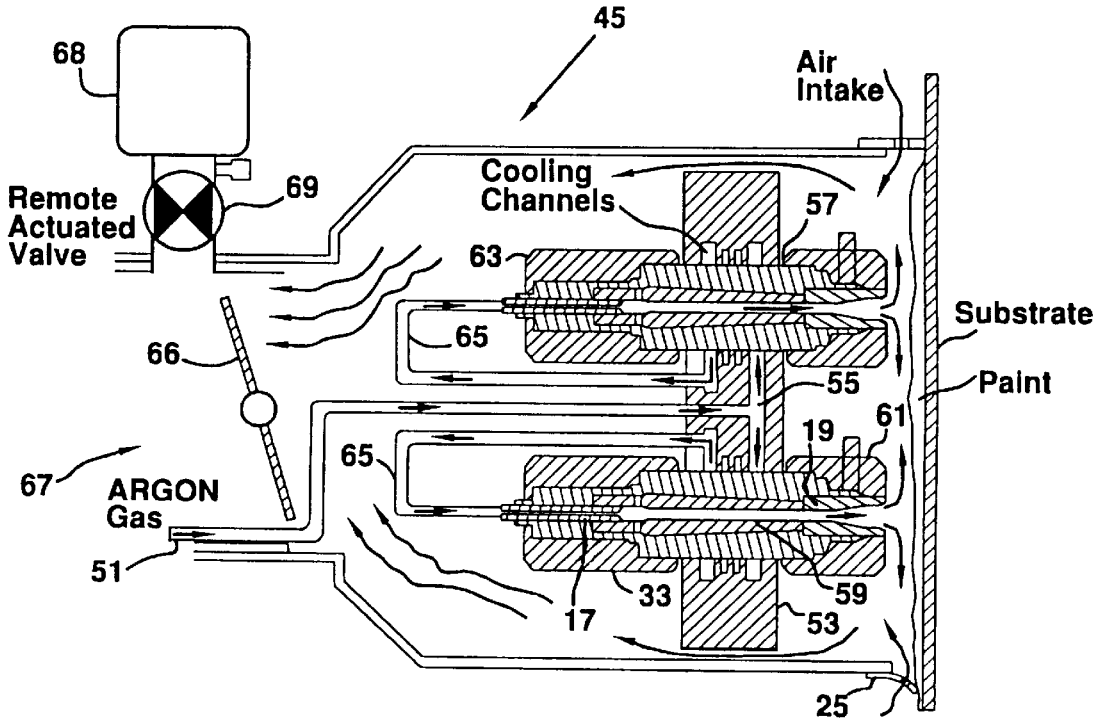

FIG. 8B shows a design for a pulsed plasma jet paint removal engineering prototype with two plasma jets.

Figure 9A:
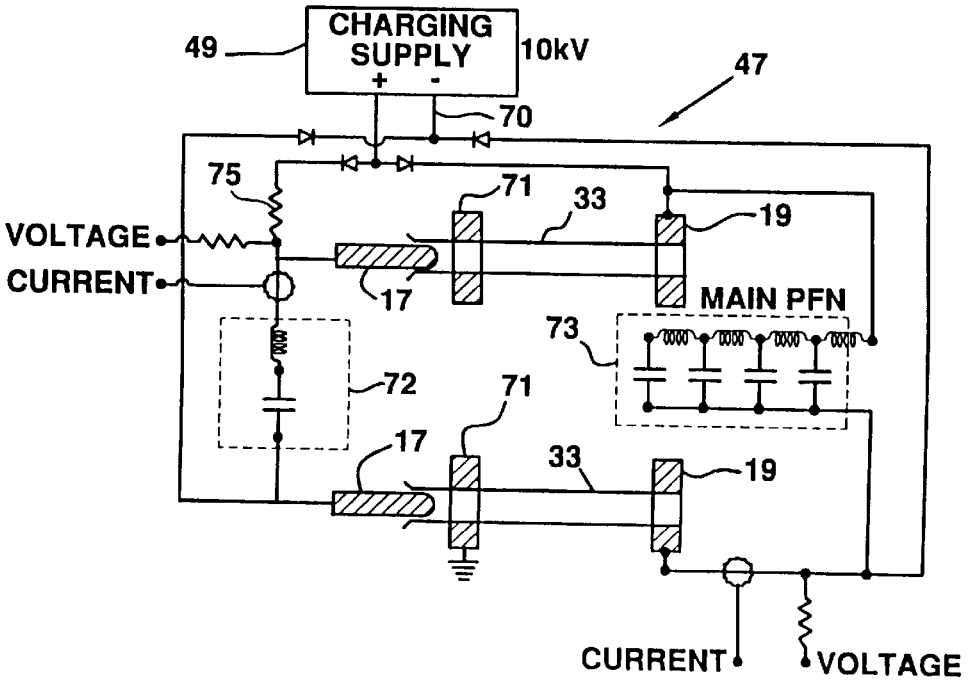

FIG. 9A shows a high voltage circuit for operating two plasma jets using only one power supply for paint removal.

Figure 9B:
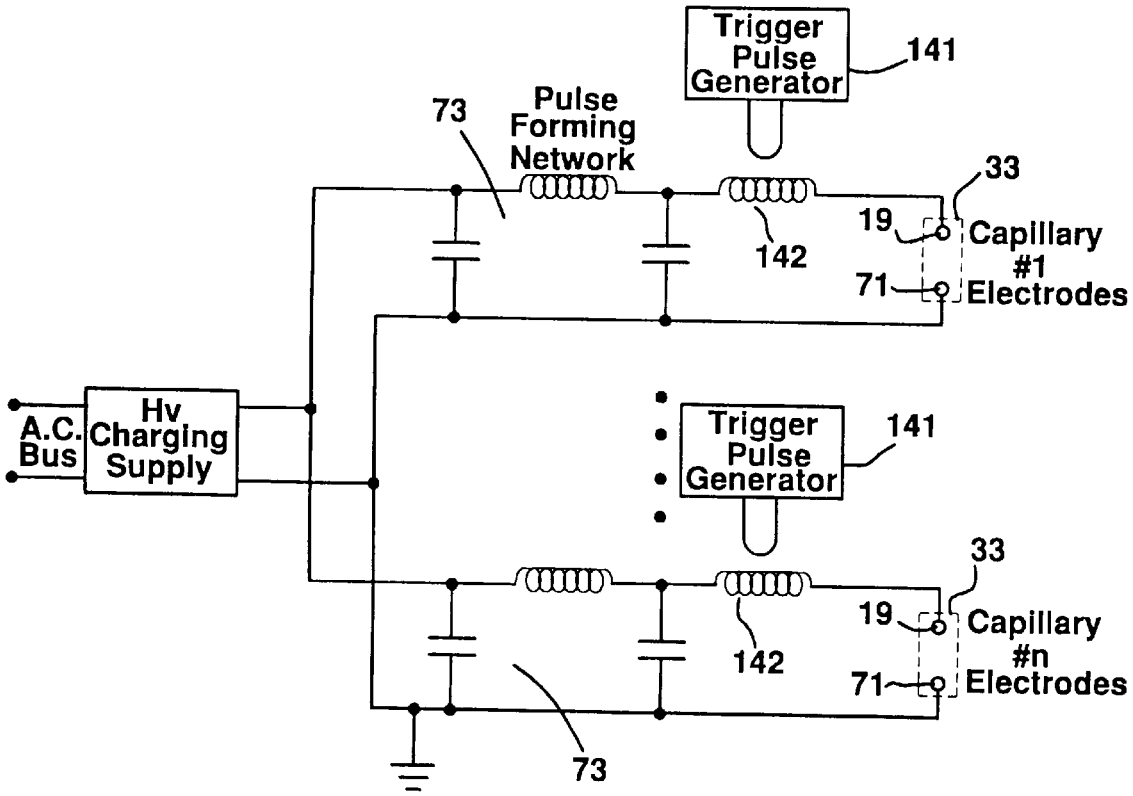

FIG. 9B shows a different high voltage circuit in which each of multiple plasma jets is driven by a separate pulse forming network.

Figure 10A:
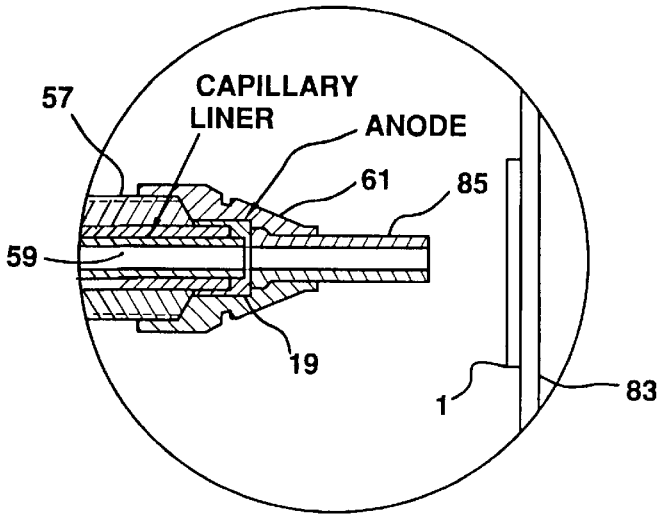
Figure 10B:
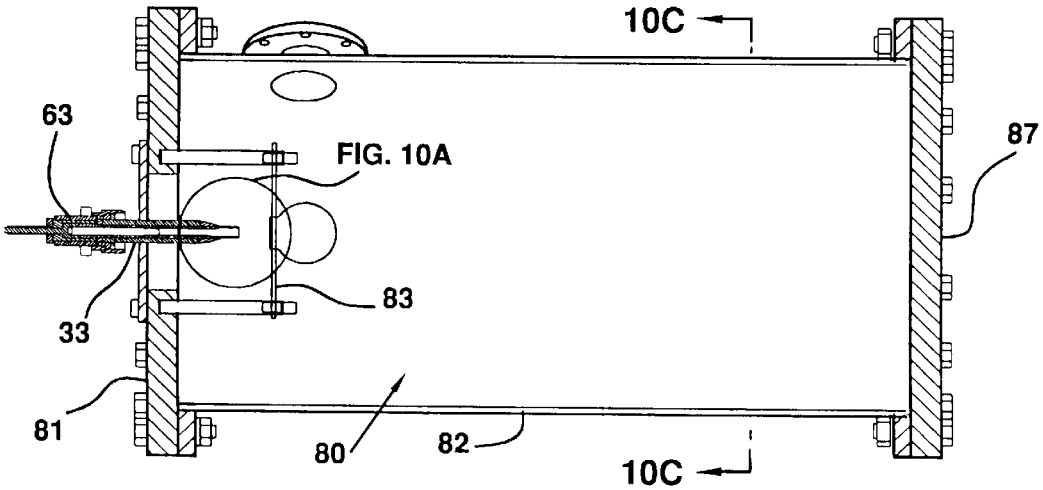
Figure 10C:
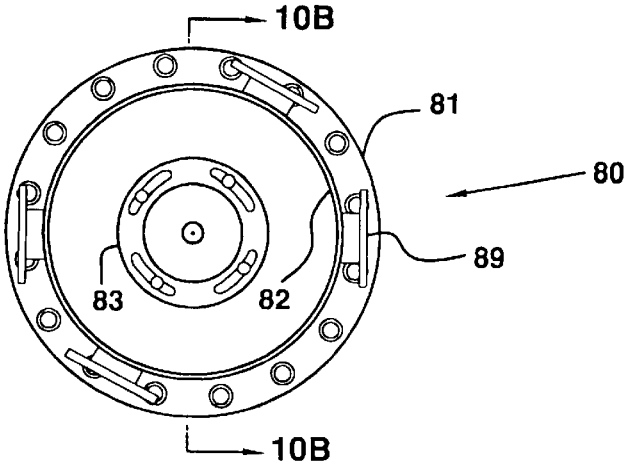

FIGS. 10A, 10B and 10C show an experimental plasma jet paint removal assembly. The gap between the nozzle and the painted sample is shown exaggerated for clarity. The actual gap was 5 mm.

Figure 11:
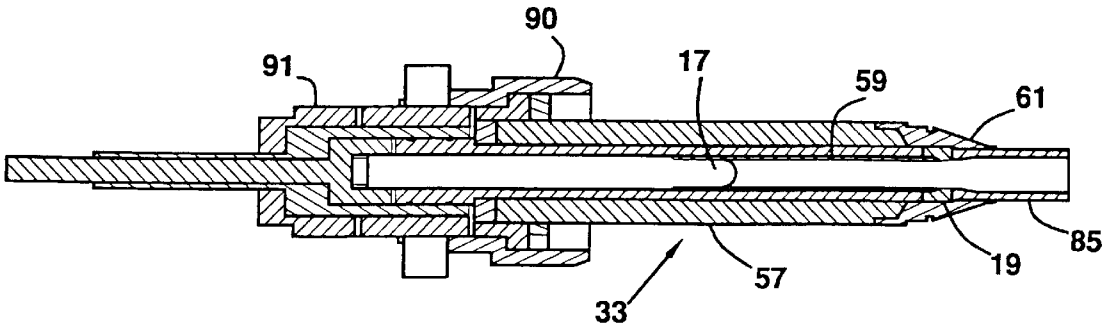

FIG. 11 shows single pulse plasma jet hardware used in experimental work. The capillary liner and exit barrel are fabricated from Lexan.

Figure 12:
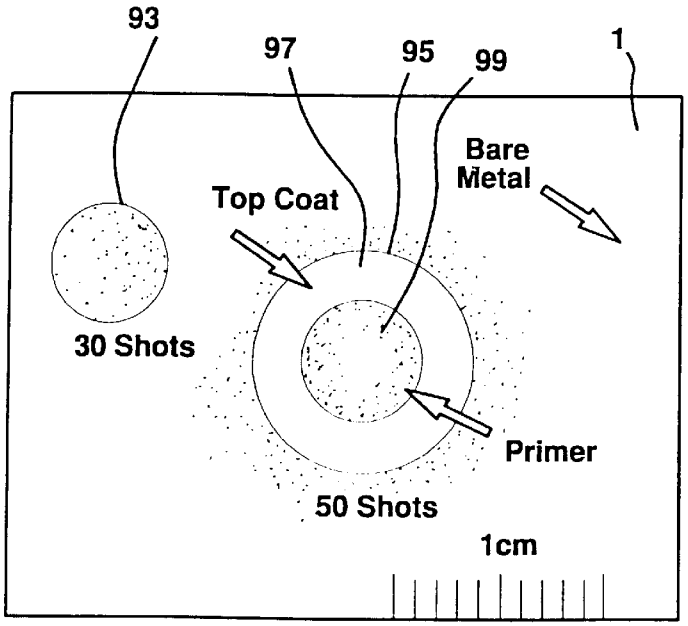

FIG. 12 is a demonstration of plasma jet pulse removal of topcoat without damage to the underlying green primer coat over an aluminum substrate. Paint is scraped away at upper right to determine its thickness. The spot at left is a 30 shot series. The central spot is a 50 shot series. All shots are at 68 J per pulse (reference test shots PR061-140).

Figure 13:
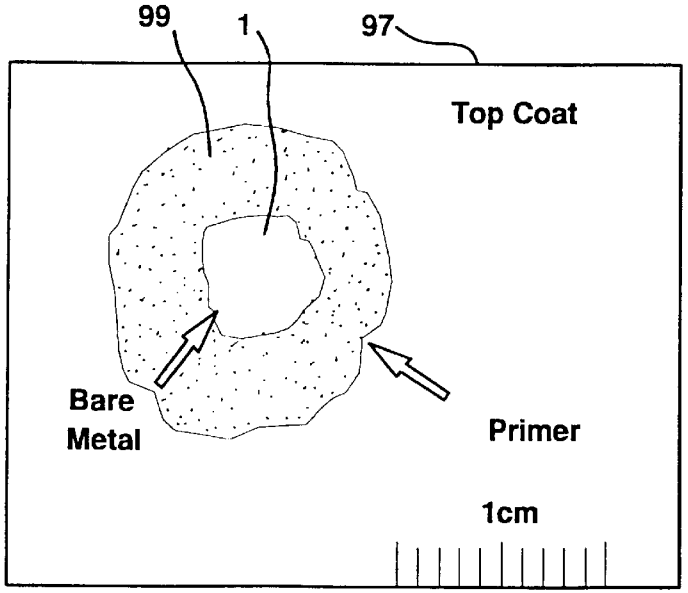

FIG. 13 is a closeup of test PR289 in which topcoat and primer are both completely removed down to the aluminum substrate using a single 1376 J pulse.

Figure 14:
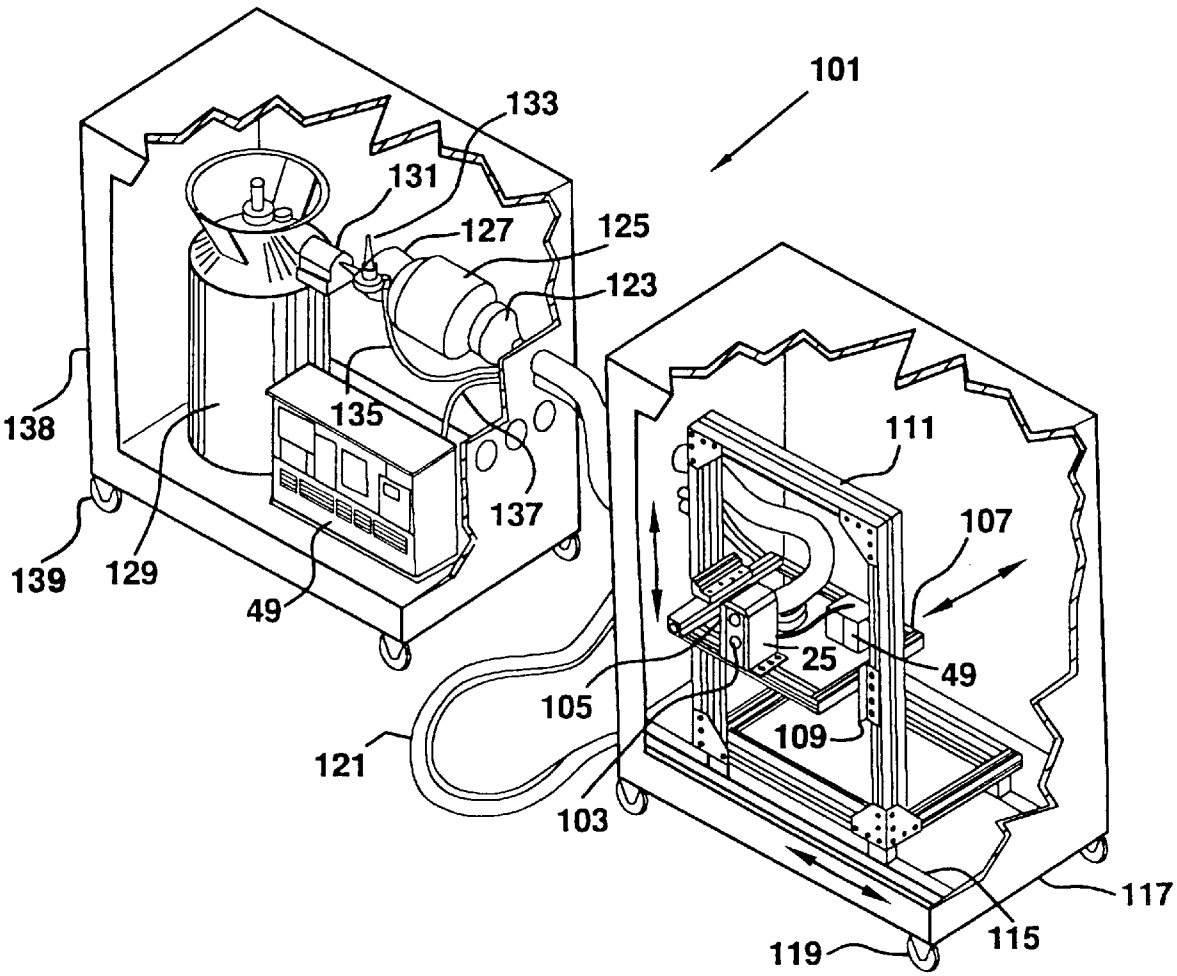

FIG. 14 shows a design for a fixture for providing 3-D directional adjustments of paint removal heads in a laboratory prototype.

DETAILED DESCRIPTION OF THE PREFERRED EMBODIMENTS

A semi-infinite solid is shown in FIG. 1. If the surface 1 at x=0 is suddenly subjected to a constant incident heat flux q 3 from the left, as indicated, the boundary surface at x=0 will initially experience a temperature rise given by $$\Delta T = \frac{2}{\sqrt{\pi\rho c\kappa}} q t^{1/2} = \alpha q t^{1/2} \tag{1}$$

where ρ, c, and κ are the density, specific heat and thermal conductivity respectively. The parameter α is a characteristic of each material. The temperature profile within the solid is given analytically by $$T(x, t) = \frac{1}{\sqrt{\pi\rho c\kappa}} \int_0^t \frac{q(\tau)}{\sqrt{t-\tau}} \exp\left[-\frac{x^2 \rho c}{4\kappa(t-\tau)}\right] d\tau. \tag{2}$$

Table 1 lists some of the pertinent physical parameters of the materials of main interest here. Steel covers most infrastructure applications such as bridges, railroad cars, and ship hulls, while aluminum is of most interest for aircraft applications. We use polycarbonate (i.e. Lexan) as a representative polymer substitute for paint. Its characteristics are well known and direct ablation data for it is available.

Heat transport within the solid is governed by the usual heat equation, $$\partial T/\partial t/\beta\nabla^2 T$$

where $\beta$ is the heat diffusivity $\kappa/\rho c_p$. This equation is solved in one dimension using a finite-difference formulation. The code predictions were benchmarked against the analytical formulas and found to be in agreement. FIGS. 2, 3, and 4 compare the calculated thermal response of steel, aluminum, and Lexan respectively to an incident heat flux of 10 $kW/cm^2$. The pulse width for the steel and aluminum is calculated out to 50 $\mu$s, while that for Lexan only goes to 20 $\mu$s since the code results are not valid once melting starts. Steel and aluminum have similar response due to the close equality of their $\alpha$'s.

Polymers are extremely poor heat conductors compared to metals, which accounts for the rapid rise in temperature at the surface of the polymer compared to that for the metals. The thermal wave depth for a suddenly impressed constant heat flux is given by $l=(\kappa t/\rho c)^{1/2}$, which is the rough distance heat penetrates in a given time and depends only on the heat diffusivity of the material, not the magnitude of the heat flux itself. Table 2 compares the three materials, showing the vast difference in the rate of heat transport between the metals and the polymer.

If the heat flux q is sufficiently large and the time t is sufficiently long, the solid will not be able to conduct the heat away quickly enough and eventually the surface will reach its melting temperature, $T_{melt}$. This occurs at a time $t_{melt}$ which is a function of the two parameters $\alpha$ and q. If, however, the heat flux is terminated at some time t less than $t_{melt}$, the surface temperature will not reach $T_{melt}$, and will instead decay away according to Equation 2 with $q(\tau)=0$ for $\tau \geqq t_{melt}$. This behavior is illustrated in the curves 5 for steel and 7 for aluminum shown in FIGS. 2 and 3 for the metals.

If the heat flux is not terminated, then for a very large heat flux, the surface temperature will rise very quickly through the melting temperature and reach the vaporization temperature, $T_{vap}$. When this occurs, the surface is said to ablate. The heat flux in this case causes such rapid heating of the solid that the energy is essentially absorbed in a very thin thermal layer at the surface of the material. This causes a very nearly instantaneous phase transformation of the outer layers to the gaseous phase. This is illustrated in the curves 9 shown in FIG. 4 for Lexan.

In the semi-infinite solid 11 shown in FIG. 5, a layer 13 of paint adheres to the surface 1 at x=0. If a large incident heat flux 3 of very short duration is directed at this paint layer, virtually all of the incident energy will be absorbed by the paint, turning all or part of it into an expanding cloud 15 of vapor. Very little heat energy will reach the substrate material due to the poor thermal conductivity of the polymer and the short duration of the heat flux. Because of the large disparity in thermal properties between paint and the underlying structures, it will always be possible to find a set of operating parameters (i.e. heat flux q, pulse width $\tau$, and rep rate) that does no thermal damage to the substrate.

The invention is shown conceptually in FIG. 6. A small capillary discharge between high voltage electrode 17 and ground electrode 19 in channel 21 is used to generate the brief heat pulse. The insulated liner 140 forming the pulsed arc discharge channel 21 is constructed of a ceramic such as boron nitride, silicon nitride, or silicon carbide to provide ablation-free operation for long life time. The pulsed discharge current of typically a few kiloamps at several hundreds of volts (under load) is supplied by relatively conventional high voltage capacitor pulse forming networks as shown in FIGS. 9A or 9B.

Ceramic insulators for capillary liners offer the best combination of temperature and chemical erosion resistance. The drawback of ceramics, of course, is their low tensile strength, but this weakness is readily overcome through the use of heat shrunk steel jacket assemblies. Ceramic insulator discharge chambers are capable of operating at pressures above 1000 atm (about 15,000 psi) without cracking under pulsed discharge conditions. This technology is expected to perform very well for the paint removal application, since peak pulsed pressures are not expected to exceed 30–40 atm (450–600 psi) in most cases.

Argon, the preferred working fluid, is introduced in gaseous form at roughly room temperature through a small orifice at the back of the discharge chamber. Argon will not radiate as a blackbody under the anticipated conditions. A ceramic capillary discharge liner is capable of operating at pulsed plasma temperatures into the 1.0 to 1.5 eV range for 100–1000 microseconds without damage to or ablation of the ceramic insulator. Since pulse widths for paint removal application are expected to be only a few 10's of microseconds, peak pulsed discharge operating temperatures of 0.5–1.0 eV are readily handled.

Capillary discharges are ideal for this application because of their ability to produce intense heat fluxes in a well controlled and predictable manner over a wide range of parameters. The vapors 23 that are generated in the paint ablation process are contained by the enclosure 25 and pumped through a hose to a collection tank for further filtering, processing, and disposal. Atmospheric air 27 drawn inward through the gap 29 at the paint surface prevents convective outflow of paint vapors and provides a working fluid 30 to transport the paint vapors 23 to the collection unit. One or two dynamic air-locks prevent convective outflow of paint vapors.

The pulsed capillary discharge produces a plasma jet 31 which impacts the painted surface creating a shocked stagnation zone over a small area for a very short time period. The heat flux directed onto the painted surface is readily controlled by adjusting arc parameters in the capillary 33 and by adjusting the position and geometry of the nozzle 35. The primary control parameters are the arc current which is easily adjusted by controlling external circuit parameters, and the capillary/nozzle geometry.

It appears to be desirable to use incident energy fluxes of about 10 kW/cm2 in order to eliminate any chance of damaging aluminum aircraft skins. Higher heat fluxes could be allowed for steel, but probably only by factors of 2 or 3. Lower heat fluxes may be necessary for composites skins, or methods of carefully controlling rep rates when a composite substrate is encountered. It is important to operate at heat flux levels, pulse widths, and repetition rates such that no damage to the substrate can occur once the coating has been removed. This is critically important for aircraft skins, but somewhat less of an issue for large robust steel structures.

The physics of the process is not one dimensional (1-D). In fact, it is strongly 2-D. Compare FIGS. 5 and 6. In FIG. 5, the ablated vapor 15 comes off the surface initially with essentially no parallel velocity along the surface. This 1-D behavior is more characteristic of ablation using a laser pulse. The ablated material forms a vapor barrier which strongly absorbs the incoming radiation. The very high power flux of lasers means this occurs on a time scale short compared to the pulse width.

Pulsed plasma jet ablation as shown in FIG. 6 is quite different from laser ablation or Flash UV in that the fluid dynamic forces play an important role in reducing overall energy requirements. The heat flux is aided by the fluid dynamic forces of the plasma jet 31 which scours the surface 1, reducing the required heat flux. The stagnation zone recovers much of the temperature and pressure in the capillary. As soon as the surface of the paint starts to soften, erosion becomes an effective removal mechanism.

In FIG. 6, the incident gas flow has a stagnation point on the axis of the jet, and is redirected to flow parallel to the surface in the ablation region. This is a high speed radial outflow, increasing from identically zero at the stagnation point to 2–3 km/s at the periphery of the jet (i.e. at ~0.5 cm radius). This flow rapidly transports vapors radially away from the stagnation region, thus reducing, although not completely eliminating, the vapor shield effect. The jet also provides a means of constantly replenishing the shocked region with energy through turbulent convective transport, a very efficient means of transporting energy. The jet also provides fluid dynamic forces which accelerate the removal process as soon as the paint begins to soften. This effect, although difficult to model, clearly reduces energy requirements.

There are two principal modes of operation, a single-pulse mode in which the entire paint layer is removed in one heat pulse, and a multi-pulse mode in which multiple pulses are required to remove the paint completely. In cases where the paint characteristics and layer thickness are well known and uniform, the single-pulse mode may have some advantages in speed of removal. However, these parameters are seldom known accurately in the field. The multi-pulse removal mode has advantages in energy efficiency (by reducing vapor shield effect), fine control (e.g. selective removal of topcoats), less substrate heating, and more operational flexibility.

FIG. 6 shows a single capillary discharge unit for conceptual clarity. An actual unit can have several such capillaries operating simultaneously in a geometrical configuration appropriate to the specific job. For instance, FIG. 7 schematically shows one such configurations 37 and 39 in which one or several nozzles 35 of capillaries are arranged linearly within an outer seal 25. In the linear array 37, all capillaries would fire approximately simultaneously as the apparatus sweeps in a direction perpendicular to the line of the capillaries. In this fashion, a wider swath of paint can be removed per sweep. The footprints of the jet on the painted surface are arranged to overlap to provide complete coverage of the area. The single unit 39 may be used for detail work.

For a single plasma jet, the spot size of removed paint will be roughly 2 to 4 times the diameter of the capillary, after expansion of the plasma jet in the nozzle. For a baseline capillary inner diameter of 0.5 cm, this implies a spot size of 1–2 cm diameter. The standoff distance between the nozzle and the painted surface will be in the range of 2 to 4 times the capillary diameter. The expansion nozzle shapes (i.e. cross-section) can be circular, elliptical, rectangular, or a combination of these, whatever is most appropriate for the specific surface and structure being worked on. All are expected to be used in various circumstances.

Speed of travel of the paint removal head across the painted surface will depend on the number of heads in the unit, the operating power level, the rep-rate, the paint thickness, etc. In any case it is expected to be adjusted to provide convenient practical speeds in the range of roughly 0.1 to 10 cm/sec Other configurations may be more useful in specific situations. For instance, the ablative apparatus can be configured to completely surround and move along structures such as beams, cables and pipes. In addition, special apparatus can provide access to awkward locations such as inside corners. The ablation process is relatively insensitive to the exact topology of the surface, since the plasma can easily reach into nooks and crannies.

In operation, the unit moves across a painted surface in a continuous motion, with the gap maintained by an adjustable free-moving bearing or other similar method. Operation can be either manual, automatic, or semi-automatic. Large structures with large flat areas would be especially amenable to automation. The apparatus could be located on a track system which allows motion in one or two dimensions. The apparatus could also be located at the end of an articulating arm under remote control. Naked girders and other similar structures on which there is something to grab can act as their own track in conjunction with specially designed rolling clamps. The physical size of the working head can range from hand held units to larger automated units, depending on the job specifics. Although a sensor could be developed to determine when the paint has been removed, visual inspection by the operator is probably the most reliable and cheapest way.

FIG. 8A shows a side view of a linear array 37 of several capillaries 33 mounted in an array block 41 which forms the enclosure 25. Plasma jets 31 provide a wide swath 43 for paint removal. This technique for increasing swath width is limited only by practical constraints regarding physical size and available electric power. One or two dimensional arrays using 10–20 jets (or more) allowing swaths several inches wide are quite feasible.

FIG. 8B shows by example a design for a two jet device 45 operated from the circuit 47 shown in FIG. 9. The plasma jet generators consist of a pair of capillary discharge units 33 operated electrically in series. The circuit provides a means by which two plasma jet generators 33, plus their associated ignition circuits, can be operated from only one charging supply 49. Argon gas 51 is supplied from a cryogenic dewar, which is the cheapest and most compact supply approach. In some cases, bottled argon gas may be preferable. The argon gas also provides active cooling of the plasma jet structure, which avoids the need for water cooling.

The working fluid is preferably an inert gas such as argon. However, virtually any gas or vaporizable liquid can be used as the working fluid, including commonly available air and water. If a liquid is used, it is fed to the capillary discharge chamber through a smaller orifice than for gas. Inert gas is preferable due to more efficient operation (due to lower energy losses to internal degrees of freedom) and better control over the vapors produced, i.e. inert gas does not introduce additional undesirable byproducts.

The argon gas is conducted to a capillary mounting block 53, which has cooling channels 55 in which the argon expands to cool the capillary jacket 57 and ceramic liner 59. Nozzles 61 are screwed onto ends of the jackets 57 to hold replaceable carbon, tungsten, or other refractory metal electrodes 19. Caps 63 hold argon distribution tubes 65 connected to the hollow electrodes 17. A valve 66 connects a low pressure source to the enclosure 25. A sampling cylinder 68 is connected to the enclosure by a remotely actuated valve 69.

The circuit in FIG. 9A provides a method of operating two capillary discharge units in series from one charging supply and two small PFN'S.

The high voltage circuit 47 shows a 10 kV supply 49 which is connected to electrodes 71, to a separate trigger PFN 72, and a main PFN 73. Charging resistor 75 limits the charging current. Voltage and current meters are connected as shown.

The capillary is initially (i.e. immediately before a given pulse) filled with argon gas at roughly atmospheric pressure, so a method of reliably initiating the arc is required. Argon is much easier to break down than air, and direct high voltage breakdown in the 5–10 kV range between electrodes 71 and 19 may be possible once repetitive operation has been established.

Breakdown can be ensured in several ways, however. The example circuit shown in FIG. 9A accomplishes this by utilizing a third guard (or trigger) electrode 17 placed very close to the rear cathode 71. A short duration, low energy, high voltage spike placed across this gap creates a spark which induces breakdown of the longer capillary between electrodes 71 and 19.

FIG. 9B shows a different high voltage circuit in which each of several capillary discharges 33 is driven by a separate pulse forming network 73. This circuit would have advantages over that in FIG. 9A when it is desired to tailor the magnitude of energy going to each capillary. For instance, it may be desirable to operate plasma jets on the periphery of an array at different energy levels or pulse widths than interior jets in order to tailor the paint removal profile. In this case independent power supplies are desired. This is accomplished with different values for the capacitors and inductors in each PFN.

In the case of FIG. 9B, the high voltage initiating spike is more easily provided by an inductively coupled high voltage spike across the electrode pairs 19 and 71. The high voltage spike is produced in a high voltage pulse generator 141 which produces a high voltage spike between electrode pairs by inductive coupling through inductor 142. This voltage spike can be many tens of kV but lasts for only nanoseconds. It produces a corona-like discharge along the inner tubular wall of capillary 33 between the electrode pairs. This annular conducting region provides a convenient low voltage breakdown path for the main capacitor bank 73 to establish the main arc discharge. This method of arc initiation has some advantages over the third guard electrode approach since it reduces system complexity and provides a more desirable initial conductivity profile.

The choice of gas injection automatically limits the allowable energy per pulse for a given capillary volume (in order to limit peak temperature). We chose an initial configuration of 0.5 cm inner diameter and 5 cm length for the engineering prototype for three reasons. 1) Capillary outflow time is given by $2l/c_s$, which is about 50 $\mu$s for the expected peak capillary sound speed of 2000 m/s. It is preferred to get all the discharge energy into the capillary on a time scale shorter than the outflow time to prevent gas overheating. 2) The size provides a comfortable weight for a handheld unit. 3) A long history of practical experience in this size range.

Shorter outflow times can be accommodated to optimize performance. Larger units operating at higher average power levels would provide higher paint removal rates. Scaling to larger or smaller size and pulsed energy levels is readily accomplished.

The working fluid is provided as argon gas at roughly atmospheric pressure inside the capillary discharge chamber 21. Argon gas is delivered through a small orifice at the back of the capillary, and is preferrably supplied from a liquid argon dewar with a regulated output pressure feed. Bottled gas can also be used but is more cumbersome and expensive. Liquid working fluids may also be fed directly to the capillaries (instead of gas) if a smaller atomizing orifice is provided at the inlet.

The capillary discharge will typically operate at an instantaneous power level of about 500 kW by discharging roughly 10 J in 20 $\mu$s. About 25–50% of this power ultimately is absorbed in the capillary structure as waste heat, leaving 50–75% making it into the jet. Of this power, perhaps 10% actually leads to convective and radiation heat transport to the surface. The rest is carried away in the plume. Additional control of the heat transport to the surface is obtained by adjusting the gap between the nozzle lip and the painted surface and by optimizing the expansion ratio of the nozzle.

The argon does double duty by providing not only the working fluid for the plasma but also serving as a cooling medium for the capillary structure. The constant flow of gas also acts to cool the painted surface between pulses. This additional cooling is probably not critical for bridges and other "robust" steel structures, but should be very helpful for application to aircraft skins or other more delicate structures or materials such as composites in which surface cooling between plasma jet pulses can prevent overheating of the surface material.

Pulse rates of 100's to 1000's of pulses per second are anticipated, yielding average power levels of 10 kW and above for a single plasma jet.

The invention has been demonstrated in a single pulse mode (manually rep-rated at 1 shot per 10–20 seconds) using ablative capillary discharge hardware and the test setup shown in FIG. 10. The plasma jet was produced by forming an arc between the electrodes 17 and 19 shown in FIG. 11, forming a plasma from ablation of the Lexan capillary insulator wall.

FIGS. 10A, 10B and 10C show a test stand to accumulate data. A capillary assembly 33 is mounted in the end 81 of a cylinder 82 which forms a chamber 80. A substrate holder 83 holds a coated substrate in front of a barrel 85 extending from the anode 19 toward the substrate. A clamp nut 61 holds the barrel 85 and anode on the capillary housing 57. Lexan liner 59 lines the capillary discharge chamber. End 87 closes the test chamber 80. Sight glasses 89 are placed in the cylinder 83 to observe the experimental apparatus.

FIG. 11 is a detail of a capillary 33. A mounting nut 90 holds the end structure 91 which holds the electrode 17 assembled in the capillary.

The invention is capable of complete removal of paint coating in one high energy pulse; complete removal of coating using many low energy pulses; and selective complete removal of the topcoat without damage to the underlying primer coat.

FIG. 12 shows the result of a 30 shot 93 and 50 shot 95 series at jet energy of 68 J, demonstrating selective removal of topcoats 97 without damage to the primer coat 99 on substrate surface 1. FIG. 13 shows the result of a single discharge of energy 1376 J, in which roughly 1 $cm^2$ of paint was removed down to the aluminum substrate 1. The total paint thickness in these tests was 0.007". Projected removal rates based on these data extends into the 100's of square feet per hour without damage to the substrate.

For comparison, paint thickness is typically about 2.5 mils/coat. Highway bridges generally have three coats (2 primers and a topcoat) for an average thickness of 7.5 mils. On some bridges repeated applications of paint over 40 or more years results in excessive paint buildups (>25 mils). Aircraft also have typical coating thickness of 6–7 mils, but generally never thicker due to weight and regular inspection constraints.

Estimation of paint removal rates are summarized in Table 3. Assuming a paint thickness of 0.007" (7 mils), a pulsed plasma unit operating at 50 kW average power would have a removal rate of 140 $ft^2$/hr. This is accomplished by either 1) placing 5 jets in one cleaning head, or 2) operating at a higher pulse rate, or 3) by using a capillary with 5 times the volume. The anticipated removal rates can be expected to increase over the proof-of-principle tests by the following changes: 1) Operating non-ablatively with argon gas should yield a factor of 2–3 increase; 2) Shorter pulses (20–30 $\mu$s) reduces the vapor shield effect, yielding an efficiency increase of 2–4; and 3) optimizing the nozzle geometry should yield another factor of 50% increase. The total possible increase ranges from a factor of 5 to 18. The optimized rates are shown in the last line of the table indicating the potential for removal rates in excess of 1000 $ft^2$ /hr.

FIG. 14 shows a fixture for providing 3-D directional adjustments of paint removal heads for a laboratory prototype. A system 101 has two paint removal heads 103 mounted in a mount 105 on a frame 107 which can be moved toward and away from the coated substrate by clamping actuator 109. Frame 107 may be moved vertically on frame 111.

Frame 111 may be moved longitudinally with base frame 113 on rails 115 in case 117, which is in turn mounted on wheels 119 for easy positioning along the length of a large item such as a painted I-beam mounted on stands in the laboratory.

The mount 105 includes an enclosure 25 which extends forward from the mount to the substrate. Suction hose 121 reduces pressure in the enclosure and draws working fluid, air and ablated materials from the enclosure 25 through sealed intake fan 123.

Scrubber 125 cleans the gases and exhausts 127 clean argon enriched air. Liquid argon is stored in dewar 129. A pump 131 pumps argon gas through a flowmeter regulator 133 and tube 135 to the capillary discharge removal heads. Power supply 49 supplies charging power and control through line 137 to the PFN 73, which powers the discharges in the capillaries. The power supply 49, argon supply 129, intake fan, scrubber and exhaust are mounted in a case 138 which moves on rollers 139.

In use the mount 105 would contain perhaps 10 to 20 heads 103 in an array. Frame 111 would be constructed to move along rails 115 mounted adjacent to the structures to be stripped of paint or attached directly to the structure, e.g. in the case of steel girders. A small mount 105 would hold one head 103 for attacking paint in crevasses. Enclosures and jet nozzles would be customized for specific geometries.

For working fluid injection the only two real injection choices for repetitive systems are either gas or liquid. Each has its pros and cons. Gas injection is the choice in this application. It can be developed faster and at lower cost than liquid systems, and it is easier to work with argon, the preferred working fluid. Liquid systems require a small orifice that could be susceptible to clogging. Liquid injection allows operation at higher energy per pulse, but this requires a heavier containment structure, which is undesirable for handheld units.

The argon gas will typically be supplied from cryogenic storage and pumped off as a gas before injecting into the capillary.

Thoriated tungsten appears to be the best electrode material choice. Graphite may provide acceptable performance at much cheaper cost for some commercial devices, and may be more acceptable environmentally. The electrodes may need to be transpiration cooled for high rep rate operation (i.e. >100 Hz). Some electrode erosion will occur, but the amounts expected are insignificant compared to the expected paint removed. Expected erosion rates are in the range of 1–2 micrograms per coulomb of transferred charge. A transfer of about 0.03–0.06 coulombs per shot, implies an erosion rate of only a 1–2 hundred milligrams per hour of continuous operation. We anticipate electrode replacement at most a few times per 8 hour work shift, which should be acceptable. Commercial versions would be designed with easily replaceable cartridge type units so that changeout is quick (a few minutes) in order to minimize downtime.

Potential substrate damage can only occur when the bare metal is exposed to the heat flux, either after the paint layer has been removed or in pathological cases in which there are holes or thin spots in the paint layer to begin with. For a heat flux of 10 kW/$cm^2$, surface temperatures are expected to reach a maximum of about 40° C. for both aluminum and steel, at the end of 20 $\mu$s pulses. After pulse end, the temperature decays very rapidly as the heat energy is dissipated into the bulk of the metal, as indicated earlier in FIGS. 2 and 3.

It is of obvious interest what happens after multiple pulses. At pulse rates of 1 kHz, the temperature will not quite return to ambient after each pulse, although the difference is very small. This difference will tend to cause a small stair-stepping upwards of the peak pulsed temperature. To determine the average rate of surface temperature increase it is sufficient to observe that a series of heat pulses is, on average, equivalent to a continuous heat flux at a value equal to the time averaged power flux. A 10 kW/$cm^2$ heat flux for 20 $\mu$s at 1 kHz is equivalent to an average continuous heat flux of 0.2 kW/$cm^2$. Using Equation 1, it is seen that the temperature would rise 90° C. for one second of continuous exposure on steel or aluminum. A 5 second exposure results in a temperature rise of 200° C. The substrate would never see these temperature rises except under exceptional conditions, and are in any case tolerable for short times. In most cases, the metal would see only 50° C., 10 $\mu$s pulses superimposed on a gradually rising background temperature.

The assessments of the possible damage modes to structural steel and aluminum substrates indicate that for the energies (yielding less than 100° C. increase in surface temperatures) and short time durations involved (10's of $\mu$s), no microstructural changes, phase transformations, or solid state precipitation will occur, even for repeated energy pulses, as long as long as dwell times on a spot are limited to no more than a few seconds. Operating conditions are chosen such that 5 seconds of continuous exposure on the bare metal has no deleterious effect. A temperature limit warning system could easily be implemented to warn the operator if limits are being approached. It will be important to keep the cleaning head moving or to temporarily reduce the rep rate if motion slows or stops. It should be possible to arrange the rep rate to be automatically controlled by the traverse speed of the device.

The use of continuous gas flow between plasma jet pulses will provide additional surface cooling (i.e. in addition to the normal cooling through conductance into the material) which tends to counteract the temperature stair-stepping effect described above. Such cooling will extend the allowed duration time on a given spot before overheating occurs, and may be crucial for removing paint from composites and aluminum aircraft skins or other "delicate" substrates where essentially zero microstructural changes are allowed.

The plasma-based paint-removal system is expected to be operated at 10 kW/$cm^2$. For this heat flux, it is seen that the surface temperature will be well below 100° C. for the tens of microseconds for which the paint-removal system is expected to be operated for each pulse. Structural steels used on highway bridges and aluminum alloys used on aircraft structures are expected to exhibit a similar surface temperature response. At these low temperatures and short pulse times, both structural steels and aluminum alloys will not undergo any microstructural changes or phase transformations.

While the invention has been described with reference to specific embodiments, modifications and variations of the invention may be constructed without departing from the scope of the invention, which is defined in the following claims.

We claim:

1. A method of removing paint from a painted surface, comprising generating a pulsed plasma within a capillary by providing an arc discharge within the capillary and directing the pulsed plasma as a pulsed plasma jet prom the capillary to the paint, ablating the paint and removing ablated paint materials.

2. The method of claim 1, wherein the removing comprises removing an outer layer of the paint.

3. The method of claim 1, further comprising introducing working fluid into the capillary, and wherein the generating of the pulsed plasma comprises rapidly heating, pressurizing and expanding the working fluid as the pulsed plasma jet, discharging the pulsed plasma jet from the capillary and directing the pulsed plasma jet against the paint, thereby heating and ablating the paint.

4. The method of claim 3, further comprising enclosing an area around the pulsed plasma jet and pumping materials from the enclosed area for preventing uncontrolled outflow of the ablated paint materials.

5. The method of claim 4, further comprising admitting air into the enclosed area for preventing uncontrolled outflow of the ablated paint materials.

6. The method of claim 3, further comprising flowing the working fluid and ablated paint materials away from an impact area of the pulsed plasma jet.

7. The method of claim 1, wherein the capillary is a single capillary, the method further comprising ablating paint from a spot on the surface by pointing the capillary toward the spot and directing the pulsed plasma jet discharging from the capillary to the spot.

8. The method of claim 1, further comprising generating a plurality of pulsed plasma jets, and removing at least one layer of the paint from the surface by directing the plurality of pulsed plasma jets from a plurality of capillaries.

9. The method of claim 1, further comprising generating a plurality of pulsed plasma jets, and arranging the plurality of pulsed plasma jets in an array and moving the array over the surface.

10. The method of claim 9, further comprising overlapping areas of the surface with the multiple pulsed adjacent plasma jets.

11. A method of removing a coating from a surface, comprising introducing working fluid into a capillary, creating a pulsed arc between electrodes at opposite longitudinal ends of the capillary, generating a pulsed plasma with the pulsed arc in the capillary, discharging the pulsed plasma from the capillary as a pulsed plasma jet and directing the pulsed plasma jet to the coating, ablating the coating with the pulsed plasma jet and removing ablated coating materials.

12. The method of claim 11, wherein the coating comprises paint and the ablating and removing comprise ablating and removing paint.

13. The method of claim 11, wherein the ablating and removing comprise ablating and removing an outer layer of the coating.

14. The method of claim 11, further comprising entraining the ablated materials in the pulsed plasma jet.

15. The method of claim 11 wherein the generating and discharging further comprise rapidly heating and pressurizing the pulsed plasma in the capillary and expanding and discharging the heated and pressurized pulsed plasma from the capillary as the pulsed plasma jet.

16. The method of claim 11, further comprising enclosing an area around the pulsed plasma jet and withdrawing material from the enclosed area for preventing uncontrolled outflow of the ablated coating materials.

17. The method of claim 16, further comprising admitting all fluid into the enclosed area for preventing uncontrolled outflow of the ablated coating materials.

18. The method of claim 11, further comprising flowing the ablated coating materials away from the surface in an incident area of the pulsed plasma jet.

19. The method of claim 11, wherein the capillary is a single capillary, the method further comprising ablating a coating from a spot on the surface by pointing the capillary toward the spot and directing the pulsed plasma jet which is discharged from the capillary to the spot.

20. The method of claim 11, further comprising arranging a plurality of capillaries in an array for generating pulsed plasma jets from the array and moving the array over the surface.

21. The method of claim 20, further comprising removing all of the coating from the surface by the pulsed plasma jets discharged from the array.

22. The method of claim 20, further comprising directing adjacent ones of the pulsed plasma jets from the array to overlapping areas of the surface.

23. A coating removal method, comprising generating pulsed plasma in a capillary between electrodes spaced longitudinally in the capillary, connecting a power supply to the electrodes for creating an arc extending longitudinally in the capillary between the electrodes, thereby creating the pulsed plasma within the capillary, discharging the pulsed plasma as a pulsed plasma jet from the capillary and directing the pulsed plasma jet toward a coating on a surface to ablate the coating and remove ablated coating material.

24. The method of claim 23, further comprising surrounding with an enclosure an area on the surface from which the coating is to be removed.

25. The method of claim 24, further comprising pumping materials from the enclosure and reducing pressure in the enclosure to below ambient for controllably removing ablated coating materials from the enclosure.

26. The method of claim 23, further comprising connecting a source of working fluid to the capillary and providing working fluid to the capillary.

27. The method of claim 23, further comprising providing an array of capillaries with discharge nozzles directed at the coating on the surface, surrounding the array with an enclosure and pumping materials from the enclosure, connecting a source of working fluid to the capillaries, providing plural longitudinally spaced electrodes in the capillaries and connecting power sources to the plural electrodes for generating longitudinally extending arcs in the working fluid within the capillaries and creating pulsed plasmas in the capillaries with the arcs, discharging the pulsed plasma from the capillaries as pulsed plasma jets and directing the pulsed plasma jets to the coating to be removed.

28. The method of claim 23, wherein the capillary is a single capillary, the method further comprising ablating all of the coating from one area with a single pulse of the pulsed plasma jet.

29. The method of claim 23, wherein the capillary is a single capillary, the method further comprising ablating all of the coating from one area with series of pulses of the pulsed plasma jet.

30. The method of claim 27, further comprising ablating all of the coating from one area with a single pulse of the pulsed plasma jets discharged from the array of the capillaries.

31. The method of claim 27, further comprising ablating all of the coating from one area with series of pulses from the pulsed plasma jets discharged from the array of the capillaries.

32. The method of claim 23, wherein the coating is paint.

33. The method of claim 1, wherein the generating of a pulsed plasma jet further comprises introducing working fluid into a capillary, creating a pulsed arc between electrodes at opposite longitudinal ends of the capillary, generating a pulsed plasma with the pulsed arc in the capillary, pulsed plasma from the capillary as the pulsed plasma jet.

34. The method of claim 1, wherein the capillary is a single capillary, the method further comprising ablating all of the paint from an area with a single pulse of the pulsed plasma jet.

35. The method of claim 1, wherein the capillary is a single capillary, the method further comprising ablating all of the paint from an area with series of pulses of the pulsed plasma jet.

36. The method of claim 8, wherein the ablating further comprises ablating all of the paint from an area with a single pulse from each of the plurality of the pulsed plasma jets.

37. The method of claim 10, wherein the ablating further comprises ablating all of the paint from an area with the series of pulses from each of the plurality of the pulsed plasma jets.

38. The method of claim 19, wherein the ablating further comprises ablating all of the coating from an area with a single pulse of the pulsed plasma jet.

39. The method of claim 19, wherein the ablating further comprises ablating all of the coating from an area with series of pulses of the pulsed plasma jet.

40. The method of claim 20, wherein the ablating further comprises ablating all of the coating from an area with a single pulse from the pulsed plasma jets discharged from the array.

41. The method of claim 20, wherein the ablating further comprises ablating all of the coating from an area with series of pulses from the pulsed plasma jets discharged from the array.

42. The method of claim 11, wherein the coating is paint.

* * * * *